United States Patent [19]

Sawazaki et al.

[11] Patent Number: 5,046,333

[45] Date of Patent: Sep. 10, 1991

[54] YARN CHANGING APPARATUS FOR CIRCULAR KNITTING MACHINE

[75] Inventors: Masatoshi Sawazaki; Hiroyuki Ueda, both of Hyogo, Japan

[73] Assignee: Precision Fukuhara Works, Ltd., Hyogo, Japan

[21] Appl. No.: 522,729

[22] Filed: May 14, 1990

[30] Foreign Application Priority Data

Jul. 5, 1989 [JP] Japan ..... 1-175243

[51] Int. Cl.[5] ..... D04B 15/61

[52] U.S. Cl. ..... 66/140 R; 66/219

[58] Field of Search ..... 66/139, 140 R, 219

[56] References Cited

U.S. PATENT DOCUMENTS 4,385,507 5/1983 Sawazaki ..... 66/140 R 4,656,842 4/1987 Sawazaki et al. ..... 66/139

FOREIGN PATENT DOCUMENTS 2710044 9/1977 Fed. Rep. of Germany ..... 66/139

*Primary Examiner*—Wm. Carter Reynolds

*Attorney, Agent, or Firm*—Bell, Seltzer, Park & Gibson

[57] ABSTRACT

A yarn changing apparatus for a multi-feed circular knitting machine includes lever arms connected to yarn feeding fingers. Vertically moveable sliders operatively connect to the lever arms and are slidable between raised and lowered positions to move the lever arms and yarn feeding fingers connected thereto, so as to place the yarn feeding fingers into operative and nonoperative positions. Vertically moveable rocking jacks pivotably connect to the sliders with each rocking jack including pivotably moveable upper and lower ends. Remotely programmed selection units are operative with the rocking jacks for aiding in pivoting the rocking jacks. The remotely programmed selection unit includes upper and lower electromagnetic block units which are energizable and act upon selectors to engage and pivot the rocking jacks. Raising and lowering cams engage the rocking jacks to raise and lower the rocking jacks during pivoting movement thereof so as to raise and lower the sliders and move the lever arms and yarn feeding fingers connected thereto between operative and nonoperative positions.

3 Claims, 6 Drawing Sheets

YARN CHANGING APPARATUS FOR CIRCULAR KNITTING MACHINE

FIELD OF THE INVENTION

This invention relates to a yarn changing apparatus for circular knitting machines and more particularly to a yarn changing apparatus for a circular knitting machine having upper and lower electromagnetic block units engageable with selectors, rocking jacks, and sliders for selectively moving yarn feed fingers between operative and nonoperative positions.

BACKGROUND OF THE INVENTION

In U.S. Pat. No. 4,385,507, a yarn changing striper box apparatus for a circular knitting machine is provided with selection units which rotate synchronously with the needle cylinder around the axis of the knitting machine. A plurality of yarn feeding fingers are arranged side-by-side and are selectively moved by the selection unit between an operative position at which yarn feeding to the needle is performed and a nonoperative position at which yarn feeding is terminated. The selection unit is controlled by a remote program, which in turn energizes a pair of solenoids. Each solenoid includes a raising cam and lowering cam along an axis thereof. The cams raise and lower jack selection members by engaging selection butts on the selection members. A three-arm rocking lever is positioned adjacent to the selection unit. The first arm of the three-arm lever is connected to the yarn feeding finger. The second arm is connected to a jack selection member. The third arm is resiliently provided with a claw for operating a cutter. During termination of yarn feeding, a yarn end catcher having moveable and unmovable blades is actuated by the claw and a rotating cam supported by the selection unit. The yarn end held thereby is cut at the time of yarn feed switching.

Although the aforementioned device offers several benefits over many existing prior art devices, this apparatus has several drawbacks. The upper and lower cams positioned on the solenoid axis which raise and lower the jack selection members are not efficient because of the linear movement imparted thereto. The selection speed provided in the apparatus is low and during speed-up of the knitting operation, efficiency is lost. Additionally, the linear movement of the solenoids mandate that a large circumferential area of the knitting machine is set aside for the solenoids. Thus, &he machine is not as compact as desired.

SUMMARY OF THE INVENTION

It is therefore an object of this invention to provide a circular knitting machine which overcomes the aforementioned difficulties of the prior art.

It is another object of the present invention to provide a circular knitting machine which includes a yarn changing apparatus adapted to correspond and operate during speed-up of the knitting operation and which is compact in structure.

These and other objects of the present invention are accomplished by the present yarn changing apparatus for a multi-feed circular knitting machine which includes a plurality of individual yarn feeding fingers arranged adjacent to each other. The yarn feeding fingers are selectively moveable to an operative position wherein yarn feeding to a needle is performed and a nonoperative position wherein yarn feeding is terminated. The apparatus comprises lever arm means operatively connected to the yarn feeding fingers. Remotely programmed selection unit means is rotatable synchronously with the needle cylinder around the axis of the knitting machine, and is operative with the lever arm means for selectively moving the lever arm means and the connected yarn feeding fingers between operative and nonoperative positions. The selection unit means includes vertically moveable sliders operatively connected to the lever arm means and slid able between raised and lowered positions to move the lever arm means and yarn feeding fingers connected thereto so as to place the yarn feeding fingers in operative and nonoperative positions.

Vertically moveable rocking jacks are pivotally connected to the sliders. Each rocking jack includes respective upper and lower selection butts, guide butts and cancelling butts. Selection means is engageable with respective selection butts on the rocking jacks for pivoting the rocking jacks. Upper and lower electromagnetic block units are positioned adjacent the respective upper and lower selection butts. Each electromagnetic block unit is individually energizable by instructions generated from an instruction program. The upper electromagnetic block unit is operable for moving the selection means outwardly into engagement with upper selection butts for pivotably moving the lower end of the rocking jack inward. The lower electromagnetic block unit is operable for moving the selection means into engagement with lower selection butts for pivotably moving the upper end of the rocking jack inward.

Raising cam means is engageable with a lower cancelling butt when the lower end is pivoted inward so as to raise the rocking jack. Lowering cam means is engageable with an upper cancelling butt when the upper end is pivoted inward. Thus, selective controlled movement of the selection means by selective energization of the upper and lower electromagnetic block knits provides selective pivotable movement of the rocking jacks to pivotably move the cancelling butts positioned on the ends of the rocking jack into engagement with either the raising or lowering cam means so as to move the yarn feeding fingers into either operative or nonoperative positions.

BRIEF DESCRIPTION OF THE DRAWINGS

Other objects and advantages will appear as the description proceeds when taken in connection with the accompanying drawings, in which.

Figure 1:
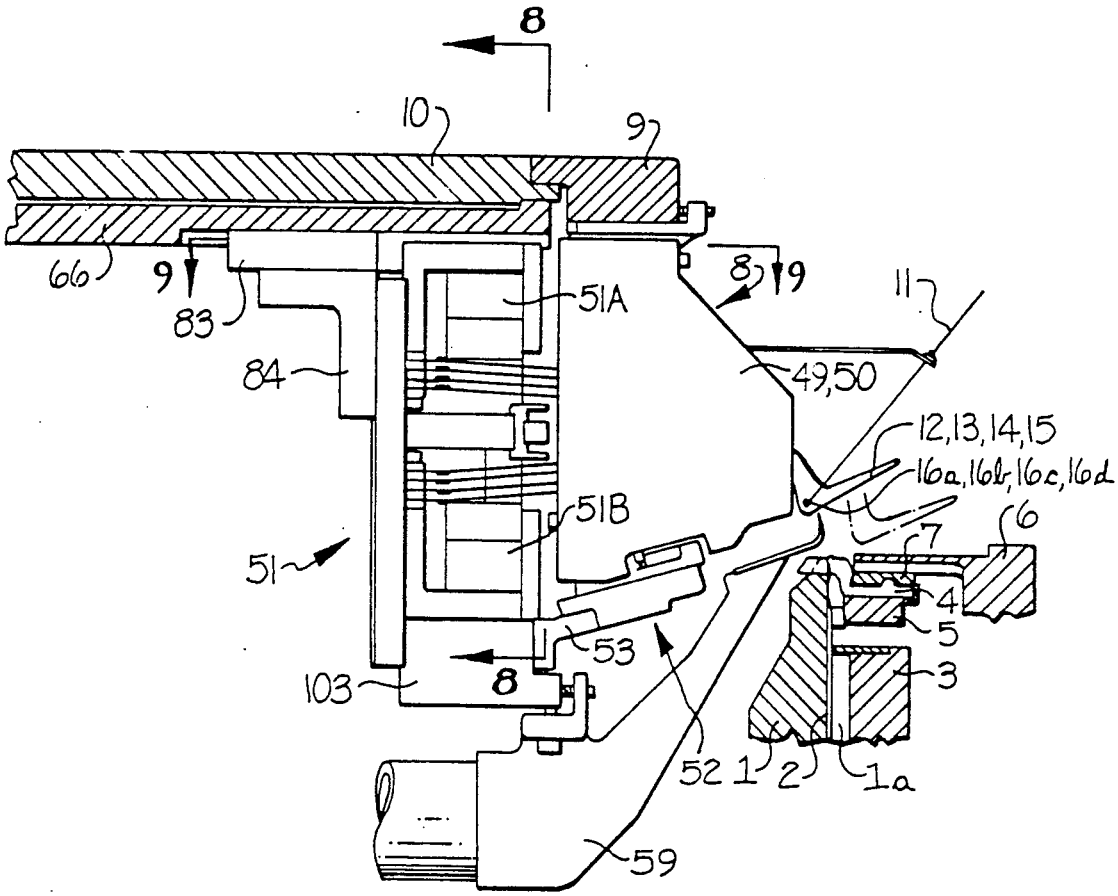
FIG. 1 is a fragmentary vertical section view through the knitting machine and illustrating the position of the feed fingers, yarn changing device, and selection unit in accordance with the present invention.
Figure 9:
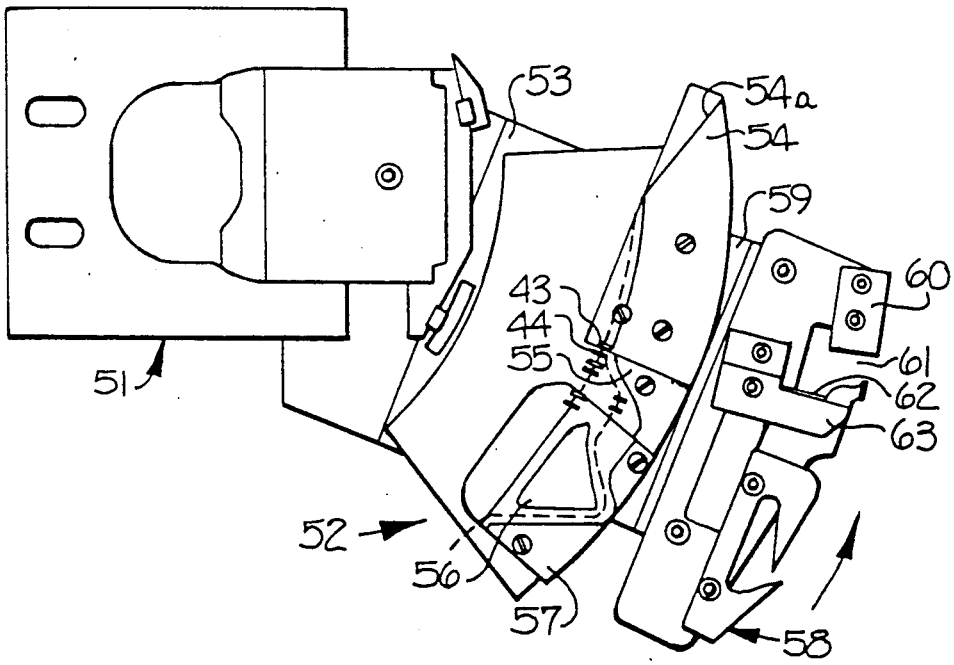
Figure 10:
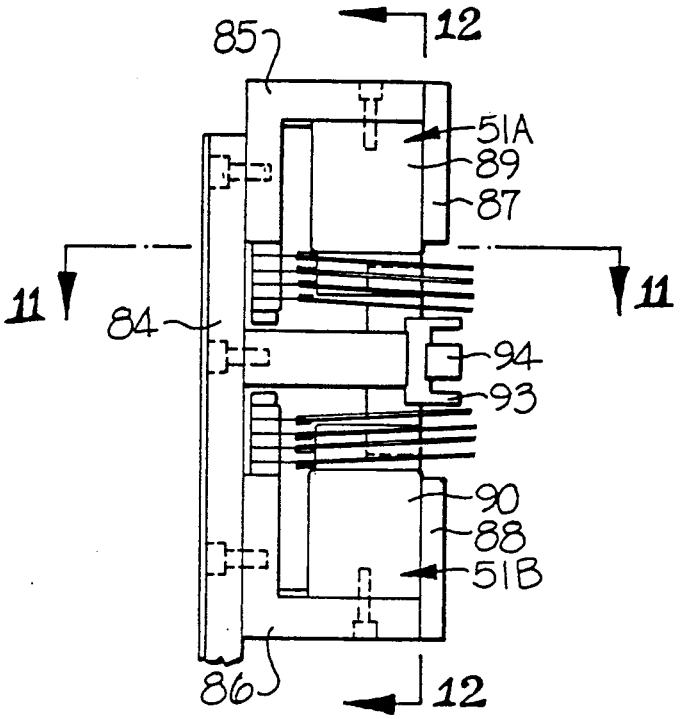
Figure 11:
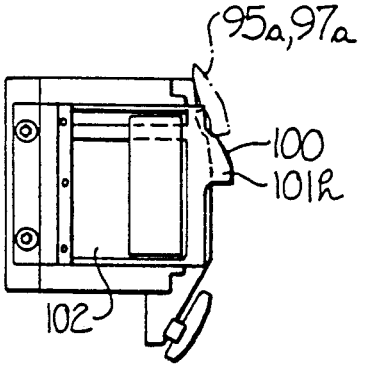
Figure 12:
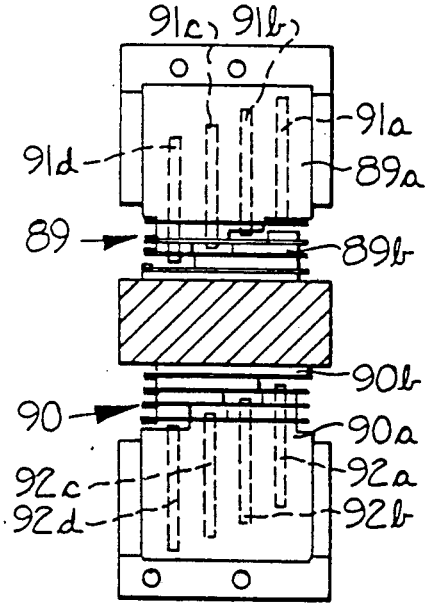

8 is an enlarged, fragmentary vertical section view taken along line 8—8 of FIG. 1 and showing the yarn selection device in accordance with the present invention;

FIG. 9 is a plan view taken along the line 9—9 in FIG. 1;

FIG. 10 is a fragmentary side elevation view of the selection device in accordance with the present invention;

FIG. 11 is a fragmentary horizontal sectional view taken along line 11—11 of FIG. 10;

FIG. 12 is a fragmentary sectional view taken along line 12—12 of FIG. 10;

FIGS. 13 A-D and 14 A-D are fragmentary side elevational views showing engagement of selectors against a rocking jack during machine operation.

DETAILED DESCRIPTION OF THE PREFERRED EMBODIMENT

As illustrated in FIG. 1, the knitting machine includes a rotatable needle cylinder 1 having vertically extending grooves la into which vertically slidable knitting needles z are mounted. A cam holder bracket 3 surrounds the needle cylinder 1, and is provided with at least one control cam (not shown) to control and actuate knitting needles z. Sinkers 4 are supported on a horizontally disposed sinker dial 5. Sinkers operate in conjunction with the needles 2 during knitting, and are radially slid able on the sinker dial 5. Sinkers 4 are actuated and controlled by a sinker cam 7 fixed to the sinker cap 6. A driving gear (not shown) is fixed to the lower end of the cylinder 1 and is suitably driven by a driving source arranged in a conventional manner on the knitting machine to rotate the cylinder 1.

Inside the cylinder 1, a yarn changing device, broadly indicated at 8 in FIG. 1, in accordance with the present invention, is fixed to an outer support plate 9 by means of a key or other similar retaining means. The support plate 9 is fixed to a cylindrical support plate 10.

Figure 2:
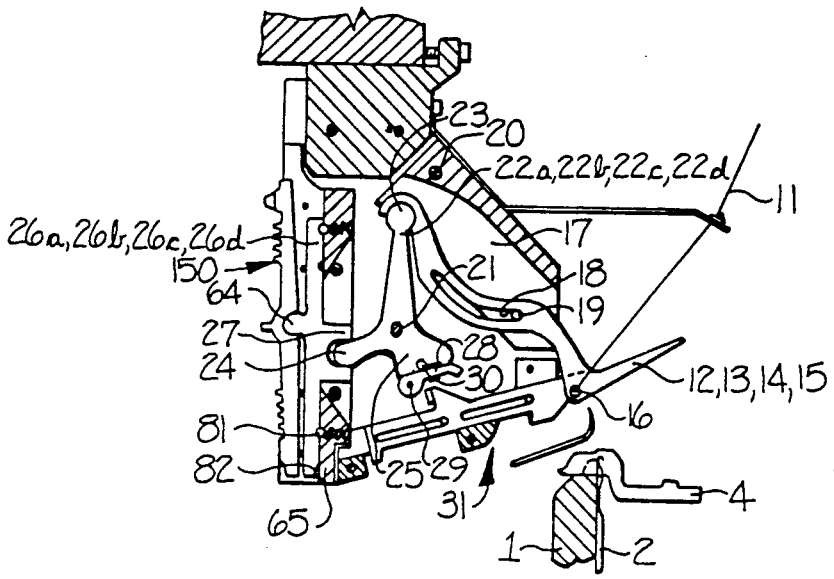
FIG. 2 is a vertical sectional view showing the positional relationship of a knitting needle, feeding fingers, lever arms, sliders and rocking jacks and showing a lever arm in a nonoperative position.
Figure 3:
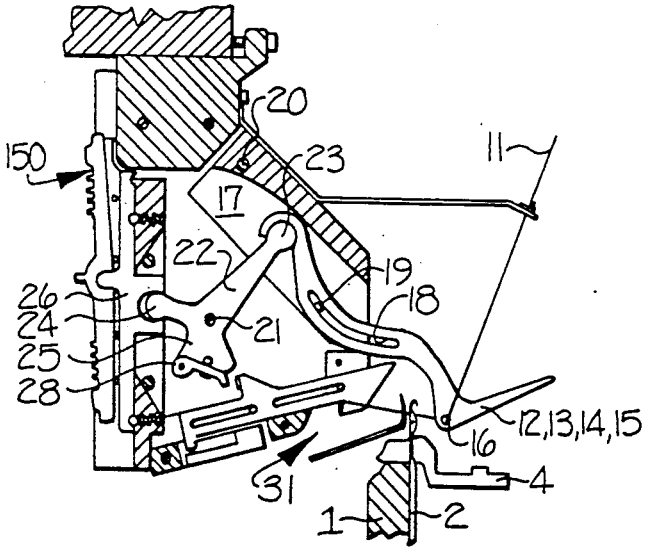
FIG. 3 is an enlarged vertical sectional view similar to FIG. 2 showing the yarn feeding finger in an operative position.

Four separate yarn feeding fingers 12, 13, 14, and 15, guide separate yarn strands 11. Yarn feeding fingers 12-15 are positioned for operation on the yarn changing unit 8, and include guide eyes 16*a*-d positioned at the lower section of the yarn feeding fingers for guiding the yarn strands 11 therethrough. Each yarn feeding finger 12-15 can be selectively moved between a lowered or operating position (as shown in FIG. 3) and an upper or nonoperating position (as shown in FIG. 2). For example, as shown in FIG. 2, the yarn feeding fingers 12-15 are in a raised, nonoperating position with the eyes 16 of the feeding fingers being in the upper position inside the cylinder 1, and the circle of needles 2. In FIG. 3, the yarn feeding fingers 12-15 are in the lowered or operating position with the yarn guide eyes 16 positioned outside the needle cylinder 1, and the circle of needles 2.

As illustrated in FIGS. 2 and 3, the yarn feeding fingers 12-15 are longitudinally slidable in the slots of finger guides 17. Each yarn feeding finger 12-15 is guided by means of elongated slot 18 formed on each finger, which receives therethrough a pin 19. The pin 19 passes through the finger guides 17, which are supported in side-by-side relationship by a bolt 20.

Respective yarn feeding fingers 12-15 are connected to lever arm means 22*a-d* in the form of a three-arm lever pivotally supported on a pivot pin 21. Each three-arm lever 22 is provided with a first arm 23, a second arm 24 and a third arm 25. The upper end of the first arm 23 is connected to respective yarn feeding fingers 12-15. The inwardly extending second arm 24 is engaged and clamped by a forked projection 27 (FIG. 2) formed on the approximate midportion of respective sliders 26*a*-d. The outwardly extending third arm 25 carries a claw 28 which is supported by a pin 29. A spring 30 (FIG. 2) is fixed to the back of the claw 25 to resiliently bias the claw 25.

Figure 5:
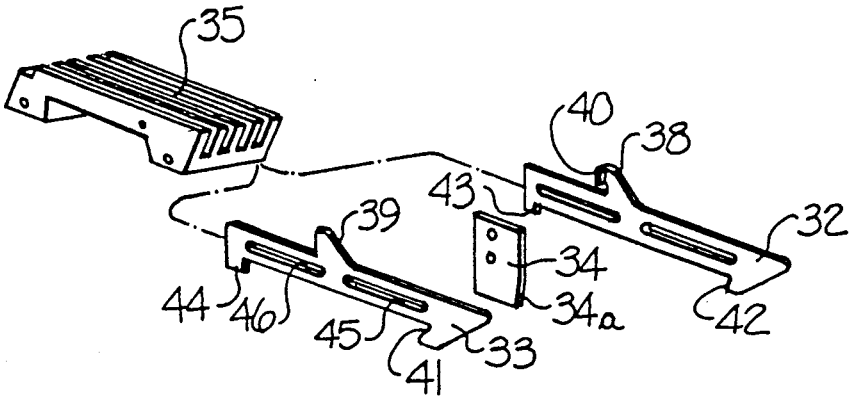
FIG. 5 is an exploded view in perspective showing a clamp and cutter and showing a supporting slotted bed.
Figure 6:
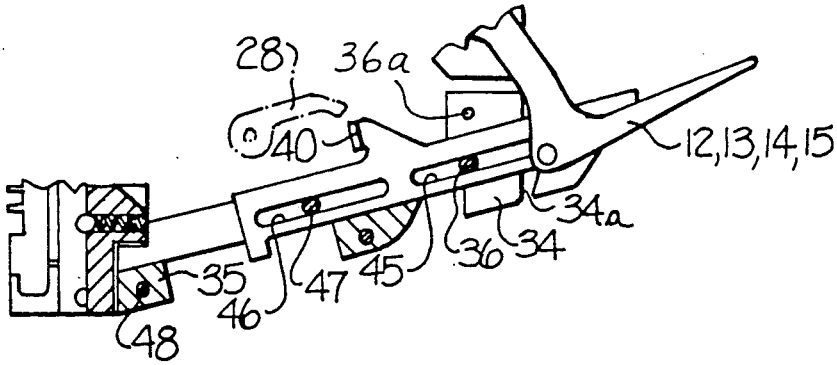
FIGS. 6 and 7 are detailed vertical sectional views of the clamp and cutter in open and closed positions; FIG.
Figure 7:
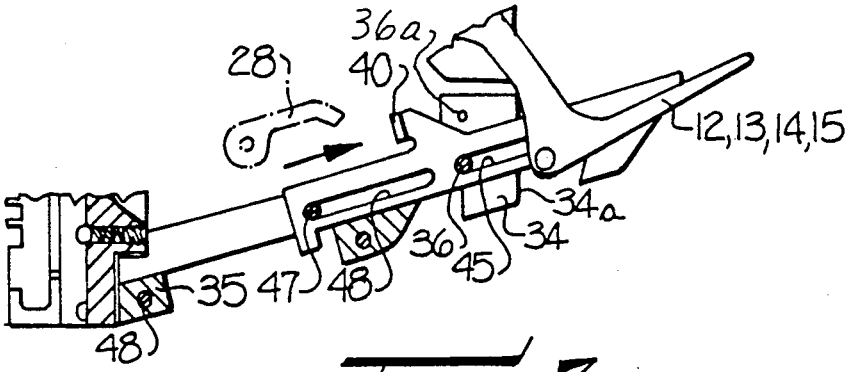

Means for holding and cutting the yarn, broadly indicated at 31 in FIG. 2, is provided adjacent the yarn feeding fingers 12-15. As illustrated in FIGS. 5-7, thee holding and cutting means 31 includes a holding-cutting unit associated with each of the yarn feeding fingers 12-15, and which is structured to include a fixed blade 34 disposed between a moveable blade 32 and a yarn catcher 33. The moveable blade 32 and yarn catcher 33 are moveable obliquely and outwardly in a slotted bed 3S. The fixed blade 34 is fixed by pins 36, 36*a* (FIGS. 6 and 7) and includes a cutting edge 34*a*. A projection 38 formed on the upper part of the moveable blade 32 includes a right angle projection 40 bent at a right angle relative to the longitudinal direction of movement of the blade 32. The projection 40 catches the projection 39 of the yarn catcher 33 for joint movement thereof. The yarn catcher 33 also includes a forward extension 41 for catching the yarn. The moveable blade 32 includes a forward extension 42 having a cutting edge. The yarn catcher 33 and moveable blade 32 include respective acting butts 43, 44 along the underside thereof.

During movement of the three-arm lever 22 from the active position shown in FIG. 3 to the inactive position shown in FIG. 2, the moveable blade 32 and yarn catcher 33 move forward in an upwardly inclining direction. Claw 28 abuts on the extension 40 as the three-arm lever 22 turns. Movement of the moveable blade 32 and yarn catcher 33 is determined by elongate holes or slots 45 and 46 which engage pins 36, 47 respectively to define the path of travel. Pin 36 passes through the fixed blade 34 positioned between moveable blade 32 and yarn catcher 33 while pin 47 passes through guide member 35*j*, which is supported by side plates 49, 50 (FIG. 1).

A rotating cam, broadly indicated at 52 in FIGS. 1 and 9 is fixed to the lower right side of selection unit 51 and engages the butts 43,44 of the respective moveable blade 32 and yarn catcher 33 so that when the moveable blade and yarn catcher move inwardly, the feeding fingers 12-15 operate so that the respective yarns are caught and cut with the joint operation of the cutting edge 42 and the fixed blade 34. The yarn ends are held between the moveable blade 32 and the yarn catcher 33.

As shown in FIG. 9, the rotating cam 52 is positioned on the upper surface of one end of a rotating arm 53 formed integrally with the selection unit 51 (FIG. 1) Rotation occurs in the direction of the arrow. During rotation, the acting butts 43, 44 are simultaneously transferred toward the center of the knitting machine by the action of a turning cam 54 having an inclining surface 54*a* engaging the butts. The acting butts 43, 44 are moved outwardly by engagement of the claws 28 with the right angle projection 40 during return of one of the yarn feeding fingers 12-15 to the inoperative position. The acting butts 43, 44 more outwardly between a guide cam 55 and an advance cam 56 to be moved further outwardly and are then are transferred inwardly by a retreating cam 57.

A yarn receiving and guiding unit, broadly indicated at 58 in FIG. 9, is fixed to a suction nozzle 59 between the revolving cam unit 52 and the needles 2. The suction nozzle 59 is fixed to an inverted L-shaped support frame 84 by means of support block 103 (FIG. 1). The yarn receiving and guiding unit 58 includes a yarn receiving member 60, which is dimensioned as wide as the group of yarn feeding fingers 12–15. When yarn feeding fingers 12–15 are moved from the nonoperative position of FIG. 2 to the operative position of FIG. 3, the yarn received by the yarn receiving member 60 (FIG. 9) falls into a cut-out portion 61 and is then cut by a cutter 62 provided on the bottom of the cut-away portion. The cutter 62 is fixed to a holder 63 on the yarn receiving and guiding unit 58.

Referring again to FIGS. 2 and 3, the sliders 26*a–d* are connected to the second arm 24 of the three-arm lever 22*a–d* by means of the forked projection 27 which receives the second arm 24 of the three-arm lever. The slider 26 is vertically moveable within a slot provided on a slider guide 65 (FIG. 2). The slider 26 moves in a range equal to the distance from a point at which one of two notches 81, 82 provided on upper and lower end portions of the slider engage a steel ball disposed on the slider guide 65 to the point at which the other notch engages with the ball. The slider 26 is connected to a rocking jack 150, which is pivotable by means of a ball joint connection 64.

Four rocking jacks 120, 130, 140, 150 (FIG. are provided and correspond to respective yarn feeding fingers 12–15 respectively which, are referred to hereafter by the broad reference numeral 150 as representative of all members. The rocking jacks 150 include upper and lower ends which are pivotable without influence relative to the position of yarn feeding fingers 12–15. Sliders 26 also are vertically slidable to move the yarn feeding fingers 121∝15 between operative and nonoperative positions.

Figure 4:
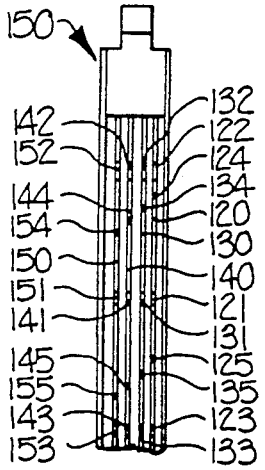
FIG. 4 is a rear elevational view showing jacks and the positional relationship of selection, guide and cancelling butts in accordance with the present invention.

Facing the inner side of the knitting machine, the rocking jacks 150 include guide butts 121, 131, 141, 151 (FIG. 4). Cancelling butts in the form of upper cancelling butts 122, 132, 142, 152 and lower cancelling butts 123, 133, 143, 153 are provided. Additionally, upper selection butts 124, 134, 144, 154 and lower selection butts 125, 135, 145, 155 are fixed thereto. The selection unit 51 includes upper and lower selection means 51A, 51B (FIGS. 1 and 10) fixed to the inverted L-shaped support frame 84 through a plate 83 at the bottom of revolving holding member 66, such as will be explained in detail later.

Referring now to FIG. 10, the upper and lower cross-sectionally L-shaped support members 85, 86 of selection means 51A, 51B support respective upper and lower outer rims or rings 87, 88. Electromagnetic block units 89, 90 are positioned in the spaces defined between cross-sectionally L-shaped members 85, 86 of selection means 51A, 51B and outer rims 87, 88 respectively. As shown in FIG. 12, each electromagnetic block unit 89, 90 comprises respective upper and lower portions 89*a*, 89*b* and 90*a*, 90*b*, which are separated from each other by a step-like groove. Respective upper and lower portions 89*a*, 90*a* include respective upper and lower cores 91*a–d*, 92*a–d*.

A cross-sectionally channel-like block 93 is fixed to the inverted L-shaped support frame 84 between the two electromagnetic block units 89, 90. A control block 94 is positioned in the central portion of the channel-like block 93 and defines upper and lower guide passages, through which the guide butts 121, 131, 141, 151 pass, depending upon whether the yarn feed fingers 12–15 are in the operating position of FIG. 3 or the non-operating position of FIG. 2.

Figure 8:
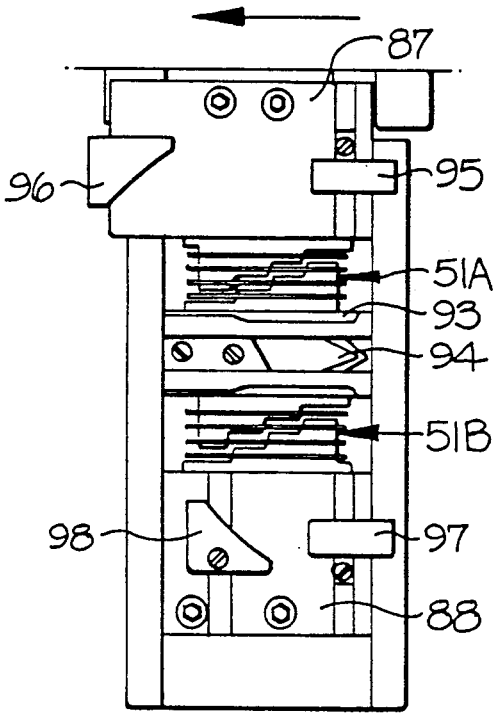
Figures 14A, 14B, 14C, 14D:
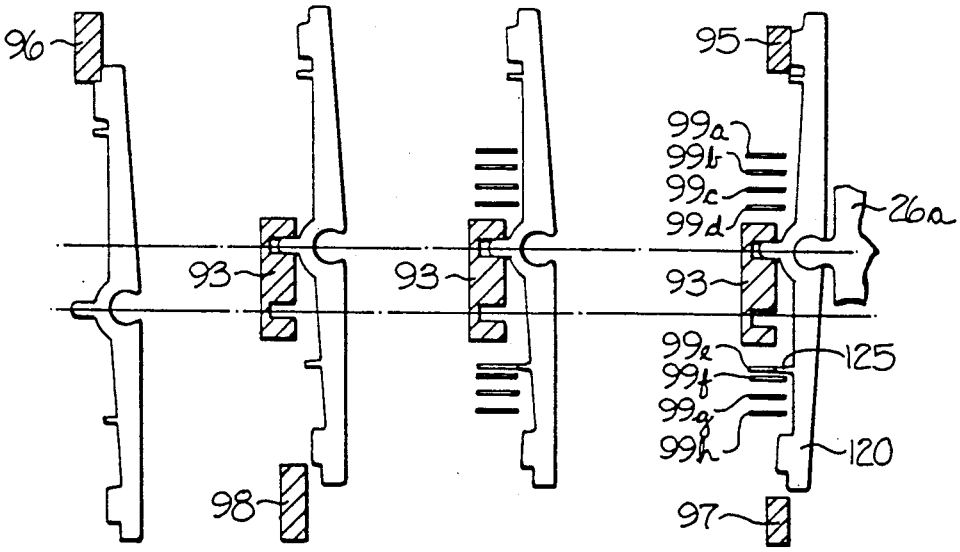

As shown in FIG. 8, cancelling cam 95 is adapted for engaging and swinging the upper end of rocking jack 150 in the upper position, as shown in FIG. 14A. Lowering cam 96, in the form of a ring cam, is adapted to engage the upper end portion of rocking jack 150 in the lower position to lower the rocking jack, as illustrated in FIG. 14D. Both cams 95, 96 are fixed to the upper outer rim 87. Second cancelling cam 97 and raising cam 98 are fixed to the lower outer rim 88 (FIG. 8). First and second cancelling cams 95, 97, include inclined portions 95*a*, 97*a* (FIG. 11) which abut the front edges of respective cancelling butts 122, 123. When the rocking jack 150 is positioned in an upper position, the yarn feeding fingers 12–15 are adapted to be in an operative position. When the rocking jack 150 is lowered, the yarn feeding fingers 12–15 remain in a nonoperative position. To lower the rocking jack 150, lowering cam 96 engages the upper edge of cancelling butt 122. To raise the rocking jack 150, the raising cam 90 engages the lower edge of the cancelling butt 123.

Selection of appropriate rocking jacks 120–150 which operatively select yarn feeding fingers 12–15 is performed by selection means in the form of individual selectors 99*a–h* (FIG. 13 A), the rear ends of which are supported by the cross-sectionally L-shaped members 85, 86. The selectors 99*a–h* are held approximately parallel with each other by spring plates at free rear ends (not shown). As illustrated in FIG. 11, a projecting extension 101*h* includes an inclining side 100 on the forward end of each selector thereof and adapted to act on the selection butts of selection members 120–150. The respective cores 91*a–d*, 92*a–d* attract corresponding selectors 99*a–h* when the cores are energized. A program reading apparatus reads an information program and generates signal through a wire (not shown) to the respective electromagnetic units to selectively energize a unit and attract a selector. An optical film, punched card matrix, and other types of information carriers can be used. As noted before, two levels of selection butts are provided. The vertical displacement of the projecting extension 101*h* is determined by the size of the step-like groove defining the base between the lower part 89*b* of the electromagnetic block unit 89 and the forward end of core 91*a–d* or the upper part and forward end of core 92*a–d*. The central part of selector 99 is cut-out and respective upper and lower portions of the step-like parts of electromagnetic block units 89, 90 pass therethrough. When the yarn feeding fingers 12–15 are in a nonoperative or inactive position, as shown in FIG. 2, the upper selection butts correspond to levels between respective projecting control parts of selectors 99*a–d* (FIG. 13 A). When the yarn feeding fingers 12–15 are in an operative or active position, as shown in FIG. 3, the lower selection butts correspond to levels between respective projecting control parts of selectors 99*e–h* (FIG. 14A). Vertically extending spaces are provided between selection butts on the selection members 120–150 so that when certain of the upper selectors 99*a–d* are upwardly moved under the action of the cores of the corresponding electromagnet 59, the selection butts abut on the projecting extensions of the corresponding selection members 120–150. When certain of the lower selectors 99*3–h* are downwardly moved under the action of the electromagnet 90, they abut on the projecting control parts of the corresponding selection members 120–150.

METHOD OF OPERATION

Figures 13A, 13B, 13C, 13D:
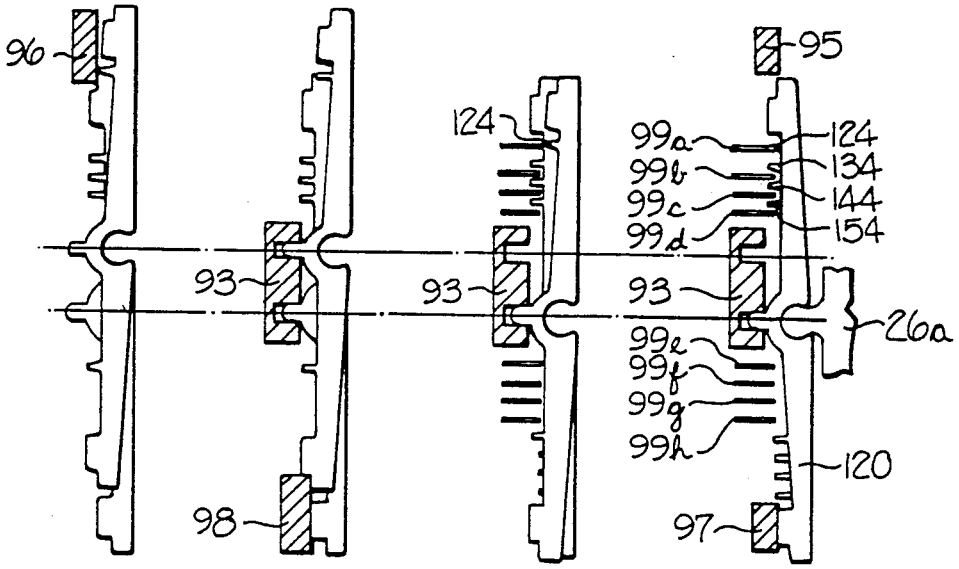

Referring now to FIGS. 8 and 9, the selection unit 51 moves in the arrow direction. When the four feeding fingers 12–15 are in a nonoperative position, as shown in FIG. 2 the lower ends of the rocking jacks 120–150 engage the second cancelling cam 97 which successively moves the lower ends of the rocking jacks 120–150 inwardly (FIG. 13A). If for example, the electromagnetic block unit core 91*a* is selectively energized by instructions generated from the information program, the corresponding selector 99*a* is raised into horizontal alignment with the corresponding selection butt 124 on the rocking jack 120 (FIG. 13A). During rotation of the revolving holding member 66, the selection butt 124 is pushed backward by the selector 99*a* (FIG. 13 B) so that the lower end of the rocking jack 120 is moved inwardly and raised by the raising cam 98. The rocking jack 120 the corresponding and slider 26*a* rise together (FIG. 13 C) so that the yarn feeding finger 12 connected to the slider 26*a* moves and is placed in an operative position, as shown in FIG. 3 to permit the yarn 11 to be fed to the knitting needle 2.

The other three selection butts 134, 144, 154 pass below the level of the projecting control parts 101*h* of respective selectors 99*b–d* so that the rocking jacks 130–150 remain in the lower position and the lower ends of the rocking jacks 130–150 are not raised and pass the outer side of the raising cam 98 (FIG. 13 C). The upper ends of the rocking jacks 130–150 pass below the lower edge of the lowering cam 96 (FIG. 13 D) so that the corresponding yarn feeding fingers 13–15 remain in inactive position, as shown in FIG. 2.

As shown in FIG. 14 A, the selector 99*e* is lowered into horizontal alignment with the corresponding butt 125 on the rocking jack 120 when the core 92*a* of the electromagnetic block unit 90 is energized. The rocking jack 120 remains in a raised position during rotation of the selection unit 51.

During passage of the selectors 99*e–99h*, the selection butt 125 corresponding to the projection of selector 99*e* is pushed outwardly to rock the upper end of the rocking jack 120 inwardly, as shown in FIG. 14B. The outwardly rocked lower end of the rocking jack 120 passes outside of and above the raising cam 98 (FIG. 14 C) whereas the inwardly rocked upper end of the rocking jack 12 engages and is moved downward by the lowering cam 96. The rocking jack 120 and corresponding slider 26*a* are thereby lowered (FIG. 14 D) whereby the corresponding yarn feeding finger 12 connected to the slider 26*a* also moves so that the yarn feeding 12 is moved and placed in inactive position, as shown in FIG. 2 and no yarn is fed to the needles of the knitting machine.

The other three selection butts 135, 145, 155 of the corresponding rocking jacks 130–150 pass above the horizontal level of the respective selectors 99*f–h* so that the lower ends of the rocking jacks 130–150 remain in an inward position. The upper ends of the non-selected rocking jacks 130–150 pass outside of the lowering cam 96 and the yarn feeding fingers 13–15 are left in inactive position, as shown in FIG. 2.

The yarn changing apparatus, in accordance with the present invention, offers several benefits over that of the prior art in which sliders are moved up and down by the linear movement of a solenoid acting on selection butts. The selectors in step-like small spaces of the electromagnetic block units act vertically and therefore, selection speed for moving the rocking jacks and sliders up and down through the selection butts on the rocking jack is made faster so that the device is capable of corresponding to speed-up of the knitting machine. A yarn changing device which is more compact in size is also obtained.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is

1. A yarn changing apparatus for a multi-feed circular knitting machine having a plurality of individual yarn feed fingers arranged adjacent to each other and selectively moveable to an operative position wherein yarn feeding to a needle is performed and a nonoperative position wherein yarn feeding is terminated and comprising (a) lever arm means being operatively connected to said yarn feeding fingers, (b) vertically moveable sliders operatively connected to said lever arm means and slidable between raised and lowered positions to move said lever arm means and yarn feeding fingers connected thereto so as to place said yarn feeding fingers in operative and nonoperative positions, (c) vertically moveable rocking jacks pivotally connected to said sliders, each rocking jack having respective upper and lower selection butts, guide butts and cancelling butts, (d) remotely programmed selection unit means being rotatable synchronously with the needle cylinder around the axis of the knitting machine and being operative with said rocking jacks for aiding in moving said lever arm means and said connected yard feeding fingers between operative and nonoperative positions, said selection unit means including selection means engageable with respective selection butts for pivoting said rocking jacks, and upper and lower electromagnetic block units positioned adjacent said selection means and each being individually and selectively energizable by instructions generated from an information program, said upper electromagnetic block unit being operable for moving said selection means into engagement with upper selection butts for pivotably moving said rocking jack lower end inward, said lower electromagnetic block unit being operable for moving said selection means into engagement with lower selection butts for pivotably moving said rocking jack upper end inward, (e) raising cam means engageable with said lower cancelling butts when said lower end is pivoted inward for raising said rocking jack, and (f) lowering cam means engageable with said upper cancelling butts when said upper end is pivoted inward for lowering said rocking jack, wherein selective controlled movement of said selection means by selective energization of said upper and lower electromagnetic block units provides selective pivotable movement of said rocking jacks to pivotably move said cancelling butts into engagement with either said raising or lowering cam means so as to move said yarn feeding fingers into either operative or nonoperative positions.

2. The apparatus as set forth in claim 1, including yarn catching and cutting means operative during yarn feeding and which includes a nonmovable blade, yarn catching means, a moveable blade, and means for actuating said moveable blade, said actuating means including a claw operatively connected between said lever arm means and said moveable blade and a turning arm supported by selection unit means and having a revolving cam for engaging said moveable blade.

3. The apparatus as set forth in claim 2, including yarn receiving means supported by said selection unit and cutter means for receiving the yarns at the time of yarn changing feeding and cutting yarn strands fed from said yarn feed fingers.

* * * * *

UNITED STATES PATENT AND TRADEMARK OFFICE
CERTIFICATE OF CORRECTION

PATENT NO. : 5,046,333

DATED : September 10, 1991

INVENTOR(S) : Masatoshi Sawazaki and Hiroyuki Ueda

It is certified that error appears in the above-identified patent and that said Letters Patent is hereby corrected as shown below:

Column 1, line 49, "&he" should be -- the --.

Column 2, line 10, "slid able" should be -- slidable --; line 39, "knits" should be -- units --.

Column 3, line 23, "z" should be -- 2 --; line 26, "z" should be -- 2 --; line 29, "slid able" should be -- slidable --.

Column 4, line 6, "25" should be -- 28 --; line 7, "25" should be -- 28 --; line 10, "thee" should be -- the --; line 17, "3$" should be -- 35 --; line 41, "35j" should be -- 35 --; line 60, "claws" should be -- claw --; line 63, "more" should be -- move --.

Column 5, line 27, after "(FIG." insert -- 4) --; line 35, "121œ 15" should be -- 12-15 --.

Column 6, line 4, after "and" insert -- outwardly --; line 21, "90" should be -- 98 --; line 62, "59" should be -- 89 --; line 65, "993-h" should be -- 99e-h --.

UNITED STATES PATENT AND TRADEMARK OFFICE

CERTIFICATE OF CORRECTION

PATENT NO. : 5,046,333

DATED : September 10, 1991

INVENTOR(S) : MASATOSHI SAWAZAKI AND HIROYUKI UEDA

It is certified that error appears in the above-identified patent and that said Letters Patent is hereby corrected as shown below:

COL. 7, line 19, after "120" insert -- and --; same line, after "corresponding" delete "and"; line 26, after "the" insert -- remaining--.

Signed and Sealed this

Twenty-ninth Day of December, 1992

*Attest:*

DOUGLAS B. COMER

*Attesting Officer*

*Acting Commissioner of Patents and Trademarks*